US010118740B2

(12) United States Patent
Miyamoto et al.

(10) Patent No.: US 10,118,740 B2
(45) Date of Patent: Nov. 6, 2018

(54) APPLICATOR

(71) Applicant: MITSUBISHI PENCIL COMPANY, LIMITED, Tokyo (JP)

(72) Inventors: Kohei Miyamoto, Fujioka (JP); Junya Uehara, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 528 days.

(21) Appl. No.: 14/797,987

(22) Filed: Jul. 13, 2015

(65) Prior Publication Data

US 2016/0009459 A1 Jan. 14, 2016

(30) Foreign Application Priority Data

Jul. 14, 2014 (JP) ..... 2014-144236

(51) Int. Cl.
*B65D 51/18* (2006.01)
*B65D 43/02* (2006.01)
(Continued)

(52) U.S. Cl.
CPC ..... *B65D 43/02* (2013.01); *B43K 23/08* (2013.01); *B43K 29/02* (2013.01); *B43K 29/05* (2013.01); *B65D 43/16* (2013.01); *B65D 43/22* (2013.01); *B65D 51/18* (2013.01); *B65D 2251/009* (2013.01); *B65D 2251/0015* (2013.01); *B65D 2251/0028* (2013.01); *B65D 2251/0059* (2013.01); *B65D 2251/0084* (2013.01)

(58) Field of Classification Search
CPC ..... B65D 43/02; B65D 43/16; B65D 43/22; B65D 51/18; B65D 2251/0015; B65D 2251/0028; B65D 2251/0084; B65D 2251/009; B43K 23/08; B43K 29/02; B43K 29/05
USPC ..... 220/254.3, 259.1
See application file for complete search history.

(56) References Cited

U.S. PATENT DOCUMENTS

2009/0230080 A1* 9/2009 Hansen ..... B65D 51/226 215/316
2010/0102022 A1* 4/2010 Kuwahara ..... B65D 47/068 215/235
(Continued)

FOREIGN PATENT DOCUMENTS

JP 9-315083 A 12/1997
JP 10-315685 A 12/1998
(Continued)

*Primary Examiner* — J. Gregory Pickett
*Assistant Examiner* — Niki M Eloshway
(74) *Attorney, Agent, or Firm* — Birch, Stewart, Kolasch & Birch, LLP

(57) ABSTRACT

An applicator includes: an applying part on a front portion thereof; a removable cap that totally covers the applying part; a sealing element that seals up a front end portion of the applying part when the cap is fitted; and an inner cap provided inside the cap. The inner cap includes an inner cap body and a hinged cap that is joined to the inner cap body and can abut the inner cap body. The hinged cap has a hollow mounting portion. An engaging portion for fixing the hinged cap is formed inside the cap. When the inner cap having the sealing element held between the inner cap body and the mounting portion is fitted into the interior of the cap, the hinged cap is engaged by the engaging portion inside the cap.

5 Claims, 19 Drawing Sheets

(51) Int. Cl.

| | |
|---|---|
| ***B65D 43/16*** | (2006.01) |
| ***B65D 43/22*** | (2006.01) |
| ***B43K 23/08*** | (2006.01) |
| ***B43K 29/02*** | (2006.01) |
| ***B43K 29/05*** | (2006.01) |
| *B65D 51/24* | (2006.01) |

(56) References Cited

U.S. PATENT DOCUMENTS

| | | | | |
|---|---|---|---|---|
| 2012/0018431 | A1* | 1/2012 | Wu | B65D 47/0895<br>220/259.4 |
| 2014/0331448 | A1* | 11/2014 | Ohtsuka | B43K 7/02<br>15/425 |
| 2015/0147106 | A1* | 5/2015 | Hashimoto | B43K 23/08<br>401/108 |
| 2015/0166224 | A1* | 6/2015 | Greiner-Perth | B65D 47/2068<br>222/153.06 |
| 2015/0344204 | A1* | 12/2015 | Anderson | B65D 51/2835<br>222/83 |

FOREIGN PATENT DOCUMENTS

| | | | |
|---|---|---|---|
| JP | 2000-62386 | A | 2/2000 |
| JP | 2009-107146 | A | 5/2009 |
| JP | 2013-173328 | A | 9/2013 |

* cited by examiner

APPLICATOR

This Nonprovisional application claims priority under 35 U.S.C. § 119 (a) on Patent Application No. 2014-144236 filed in Japan on 14 Jul. 2014, the entire contents of which are hereby incorporated by reference.

BACKGROUND OF THE INVENTION (1) Field of the Invention

The present invention relates to a feed type applicator with an applying part covered by a cap.

(2) Description of the Prior Art

Conventionally, there have been applicators that have a writing tip sealed up by a sealing element arranged on a cap when the cap is fitted, as disclosed in Patent Documents 1 to 5.

When used with a high viscosity or adhesive content liquid, these applicators entail risk that the writing tip and the sealing element stick to each other, causing the sealing element to come off or be dislodged.

In order to solve this problem, it is necessary to take measures to prevent the sealing element from coming off by improving the strength of engagement between the sealing element and the fixing member for the sealing element.

Concerning the countermeasures, there has been a method disclosed in Patent Document 3 in which an inner cap is fitted from the rear side to be fixed inside the cap.

However, in the cap for a writing implement of this Patent Document 3, a crown screw is fitted from the front side of the cap into the inner cap and engaged therewith so as to hold and fix a sealing element between the inner cap and the crown screw.

In another configuration, when a sealing element is fixed by using an inner cap, undercuts (see Patent Document 5) or face-cutting is used to fix sealing rubber.

In this case, if the tip of the applying part comes into liquid contact with the sealing rubber and becomes stuck, the sticking may produce a greater bonding force than the fixing force, causing the sealing rubber to come off from the cap.

When undercuts and face-cutting are used to improve the fitting strength, provision of fitting margins exceeding a predetermined amount is considered to be impossible because assembly of the sealing rubber into the inner cap becomes infeasible.

When other fixing methods than use of undercuts and face-cutting are investigated, fixing of the sealing element is performed by fitting methods as in Patent Document 1. However, the method disclosed in Patent Document 1 uses a sealing element of a complicated configuration so that use of thermoplastic elastomer is required, hence needing extra steps and effort such as application of heat and the like.

PRIOR ART DOCUMENTS

Patent Documents

[Patent Document 1]
Japanese Patent Application Laid-open 2009-107146
[Patent Document 2]
Japanese Patent Application Laid-open H09-315083
[Patent Document 3]
Japanese Patent Application Laid-open 2000-62386
[Patent Document 4]
Japanese Patent Application Laid-open 2013-173328
[Patent Document 5]
Japanese Patent Application Laid-open H10-315685

SUMMARY OF THE INVENTION

In view of the above circumstances, it is an object of the present invention to provide an applicator that can improve fitting force for preventing the sealing element from coming off with a simple structure.

According to the present invention, an applicator includes:

an applying part on a front side of the applicator;

a removable cap that totally covers the applying part;

a sealing element that seals up a front end portion of the applying part when the cap is fitted; and, an inner cap provided inside the cap, the inner cap includes:

an inner cap body; and a hinged cap that is joined to the inner cap body and can abut the inner cap body, wherein the hinged cap has a mounting portion having an opening, an engaging portion for fixing the hinged cap is formed inside the cap, when the inner cap having the sealing element held between the inner cap body and the mounting portion is fitted into the interior of the cap, the hinged cap is engaged by the engaging portion inside the cap so that the sealing element can be seen through the opening of the mounting portion, and when the cap is fitted to the applicator, the front end portion of the applying part comes into contact with the sealing element and is sealed up.

In the present invention, it is preferable that the inner cap body and the hinged cap are joined by a bendable hinge structure.

In the present invention, it is preferable that an engagement structure is provided between the hinged cap and the inner cap body, and when the hinged cap is folded at the hinge structure in a state that the sealing element is held in the inner cap body, the hinged cap and the inner cap body are engaged with each other by the engagement structure.

In the present invention, it is preferable that a sectional area of an opening of the applying part is 0.2 $mm^2$ or greater.

In the present invention, it is preferable that the application liquid to be applied by the applicator contains solids content of 5% by weight or greater as a coating component. Herein, the coating component indicated a curing resin for fixing the application liquid applied to a nonabsorptive surface, to the surface. Examples include acrylic resin, urethane resin.

Advantages of the Invention

According to the present invention, the applicator is configured such that when the inner cap is mounted into the cap with the sealing element held between the hinged cap and the inner cap body by bending the hinged cap at the hinge structure, the hinged cap can be engaged and fixed with the engaging portion inside the cap, and the sealing element is arranged so as to be seen through the opening of the mounting portion, it is possible to achieve excellent operation and effect of firmly fixing the sealing element with a simple configuration.

DESCRIPTION OF THE PREFERRED EMBODIMENTS

The embodiments of the present invention will hereinafter be described with reference to the accompanying drawings.

FIGS. 1*a* to 5*b* are illustrative diagrams of an applicator provided with the cap according to the first embodiment of the present invention.

Figure 1A:
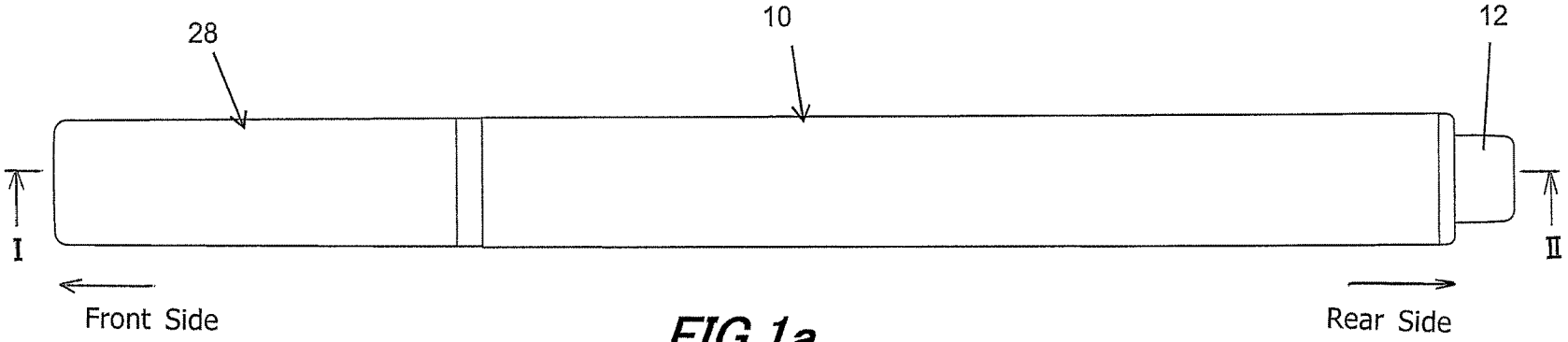
FIG. 1*a* is an external view of an applicator according to a first embodiment of the present invention, with a cap attached.
Figure 3C:
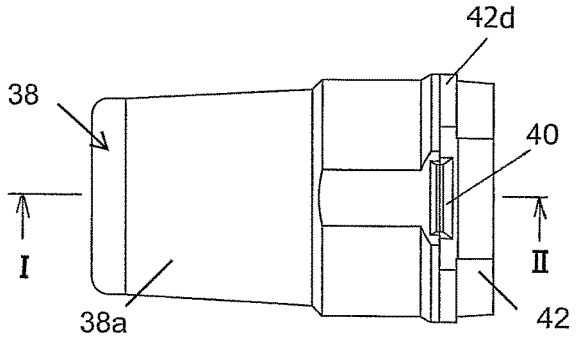
FIG. 3*c* is a side view of the inner cap according to the first embodiment, viewed from a hinge structure side.
Figure 3A:
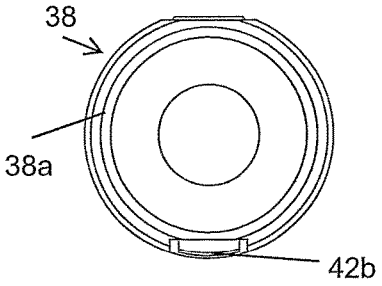
FIG. 3*a* is a view of an inner cap according to the embodiment of the present invention, viewed from its front side.
Figure 3D:
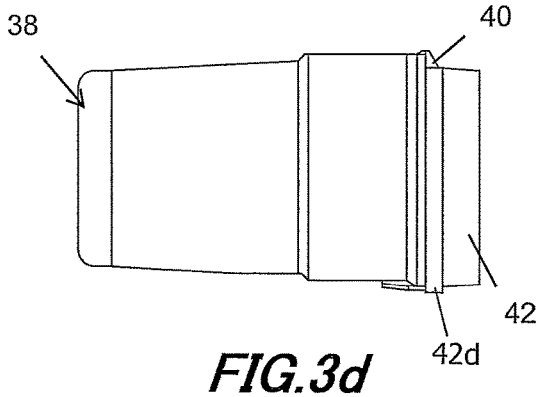
FIG. 3*d* is a side view of the inner cap with the hinge structure up according to the first embodiment.
Figure 3B:
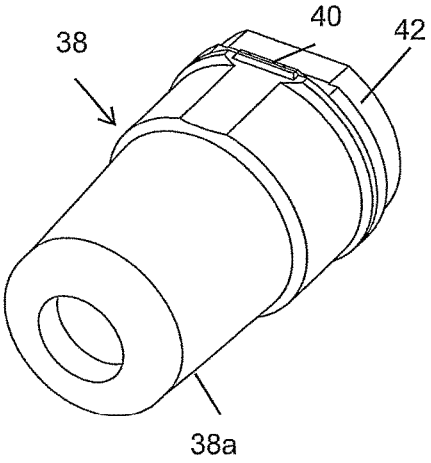
FIG. 3*b* is a perspective view of the inner cap according to the first embodiment, viewed from its front side.
Figure 4A:
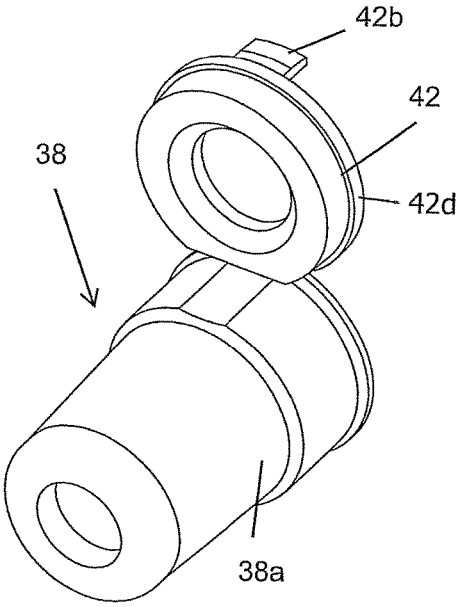
FIG. 4*a* is a perspective view of the inner cap with a hinged cap opened according to the first embodiment, viewed from its front side.
Figure 4C:
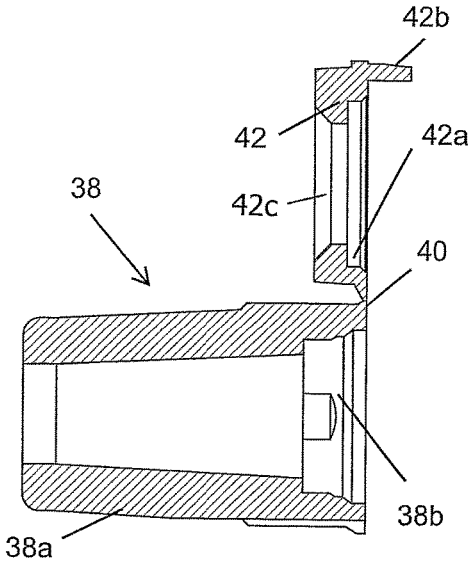
FIG. 4*c* is a vertical sectional view of FIG. 4*b*, cut along a line I-II in FIG. 4*d;*
Figure 4B:
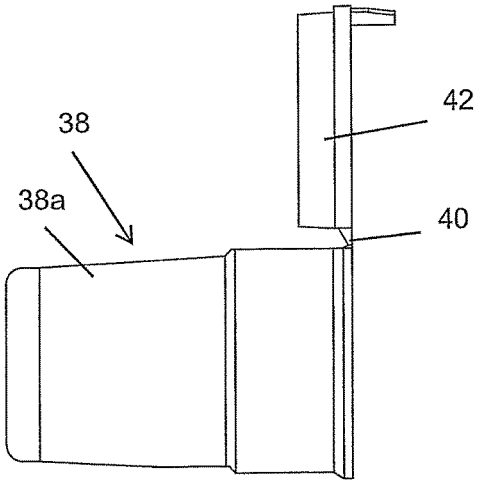
FIG. 4*b* is a side view of the inner cap with the hinged cap opened according to the first embodiment.
Figure 4D:
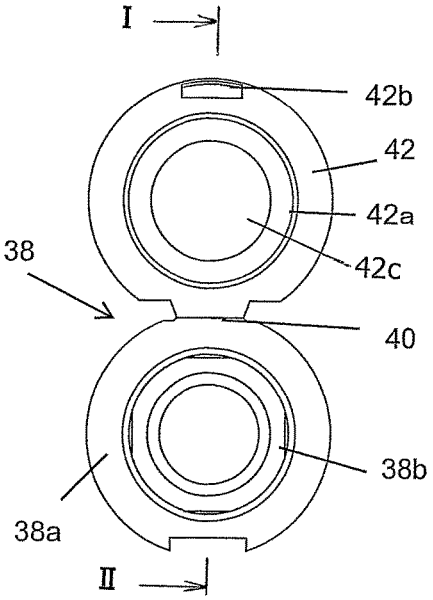
FIG. 4*d* is a view of the inner cap with the hinged cap opened according to the first embodiment, viewed from its rear side.
Figure 4E:
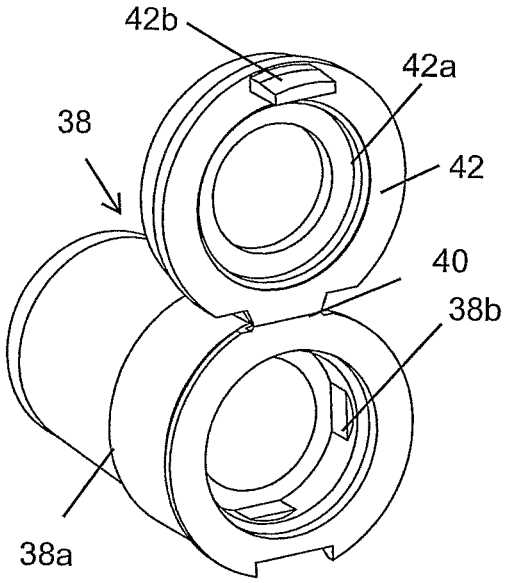
FIG. 4*e* is a perspective view of the inner cap with the hinged cap opened according to the first embodiment, viewed from its rear side.
Figure 4F:
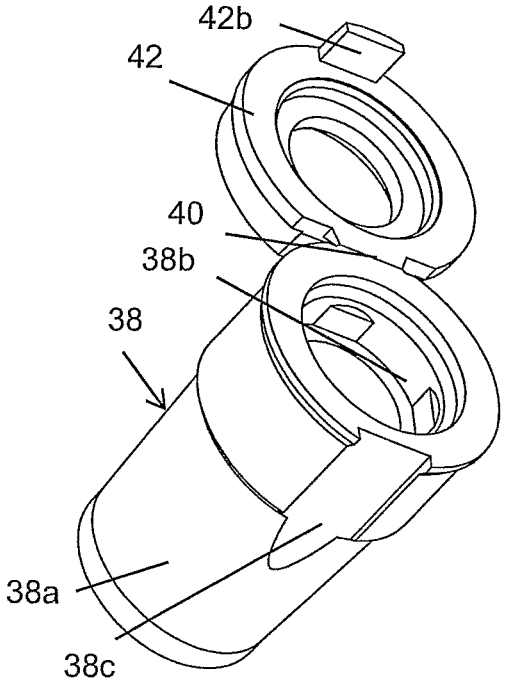
FIG. 4*f* is a perspective rear view of the inner cap with the hinged cap opened according to the first embodiment, viewed from its main body side.
Figure 5A:
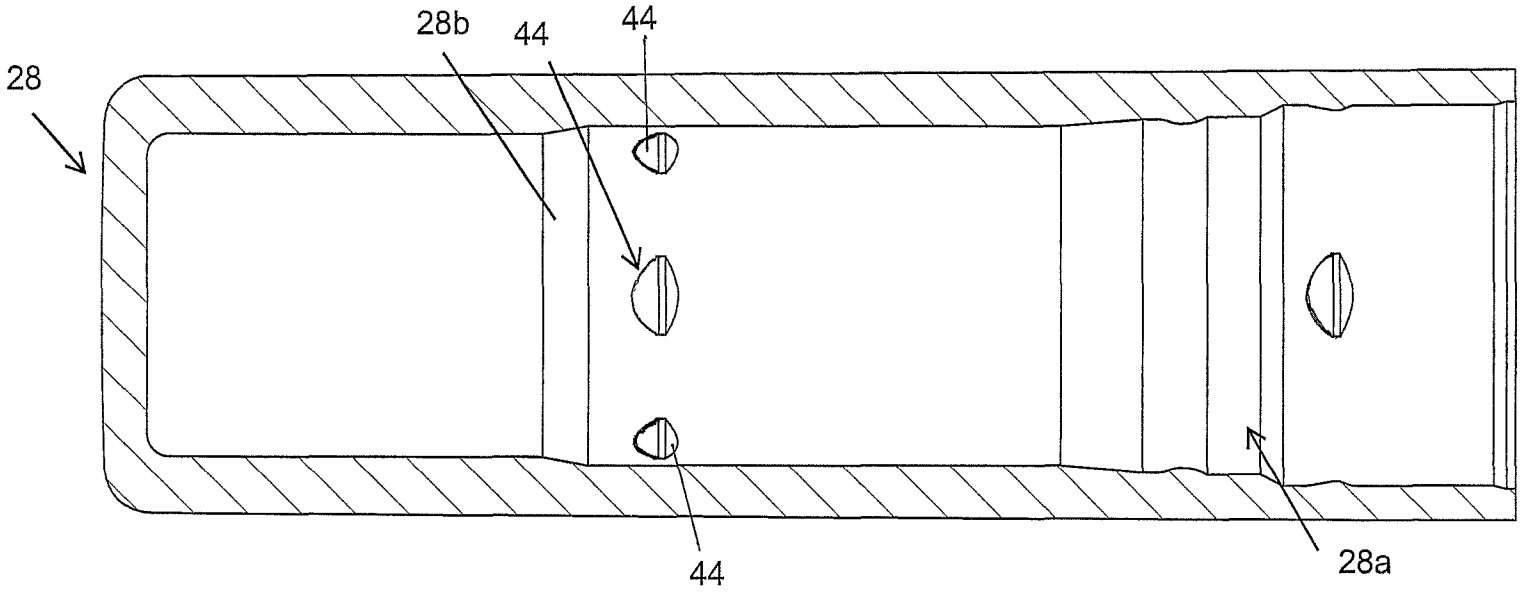
FIG. 5*a* is a vertical sectional view showing the cap in FIG. 2*a* only.
Figure 5B:
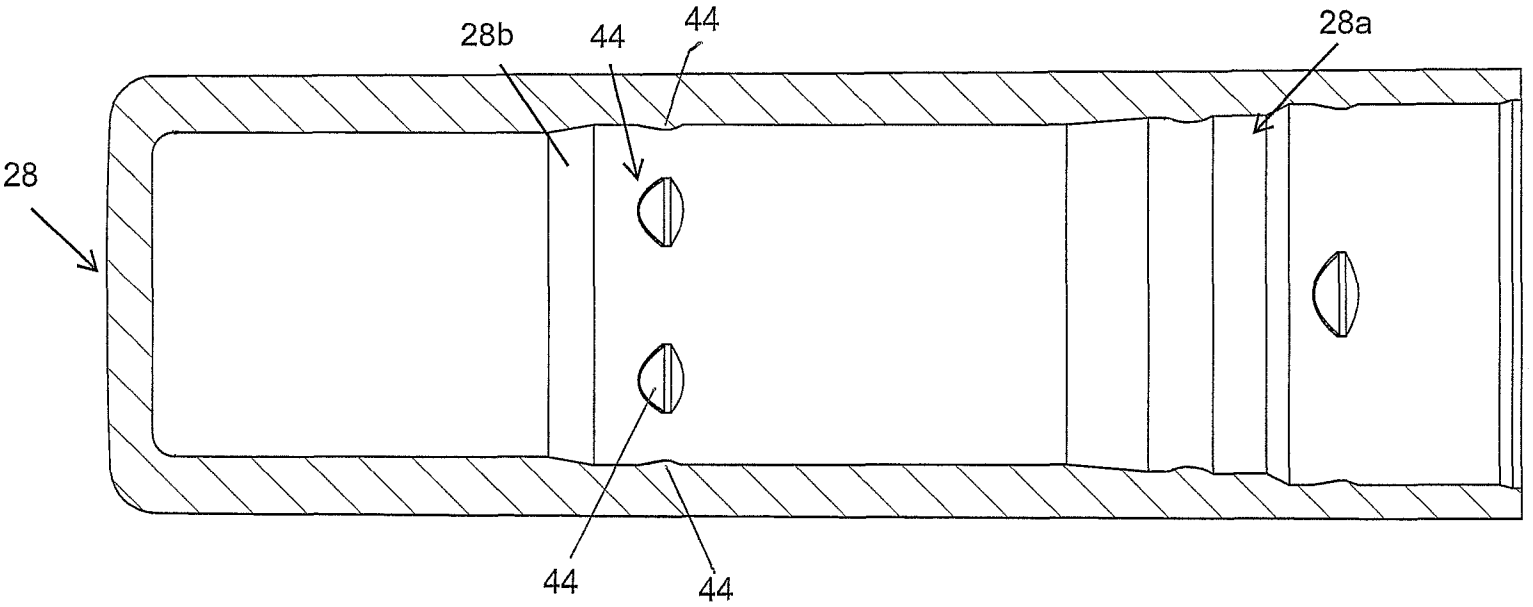
FIG. 5*b* is a vertical sectional view cut along a line I-II in FIG. 5*a*, as viewed from a position rotated 90 degrees from the position in FIG. 5*a;*

Here, in the following description, FIGS. 1*a* and 1*b* may also be collectively referred to as FIG. 1. FIGS. 2*a* and 2*b* may also be collectively referred to as FIG. 2. FIGS. 3*a* to 3*h* may also be collectively referred to as FIG. 3. FIGS. 4*a* to 4*f* may also be collectively referred to as FIG. 4. FIGS. 5*a* and 5*b* may also be collectively referred to as FIG. 5.

The applicator according to the first embodiment is a click-feed container that can feed contents by pushing a click cover 12 arranged at rear end of a barrel body (barrel cylinder) 10 forward in the axial direction, as shown in FIG. 1.

In the following description of the applicator of FIG. 1, the cap 28 side will be referred to as the front side with respect to the extended direction (axial direction) of the axis of the applicator, whereas the click cover 12 side will be called the rear side with respect to the axial direction.

The applicator includes a clicking mechanism A for converting pressing force of the user's clicking action acting on the click cover 12 into rotational force, a threaded body 14 fixed to the barrel body 10 (barrel cylinder) and a screw rod 16 mated with the threaded body 14. The rotational force converted by the clicking mechanism A rotates the screw rod 16, whereby the screw rod 16 advances through the threaded body 14 so as to push a resilient piston 18 at the front end of the screw rod 16 to feed the contents from a reservoir 20.

Figure 1B:
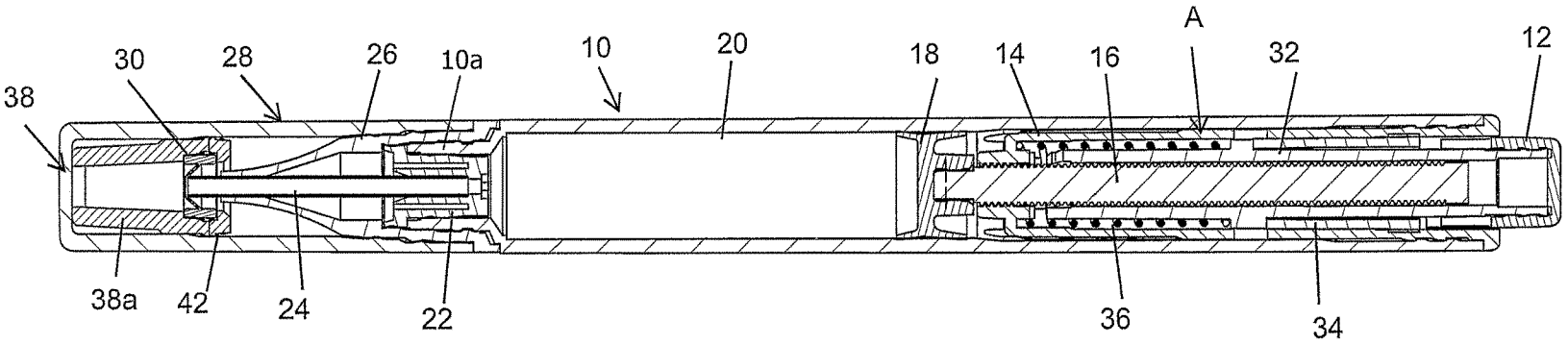
FIG. 1*b* is a vertical sectional view cut along a line I-II in FIG. 1*a;*
Figure 2A:
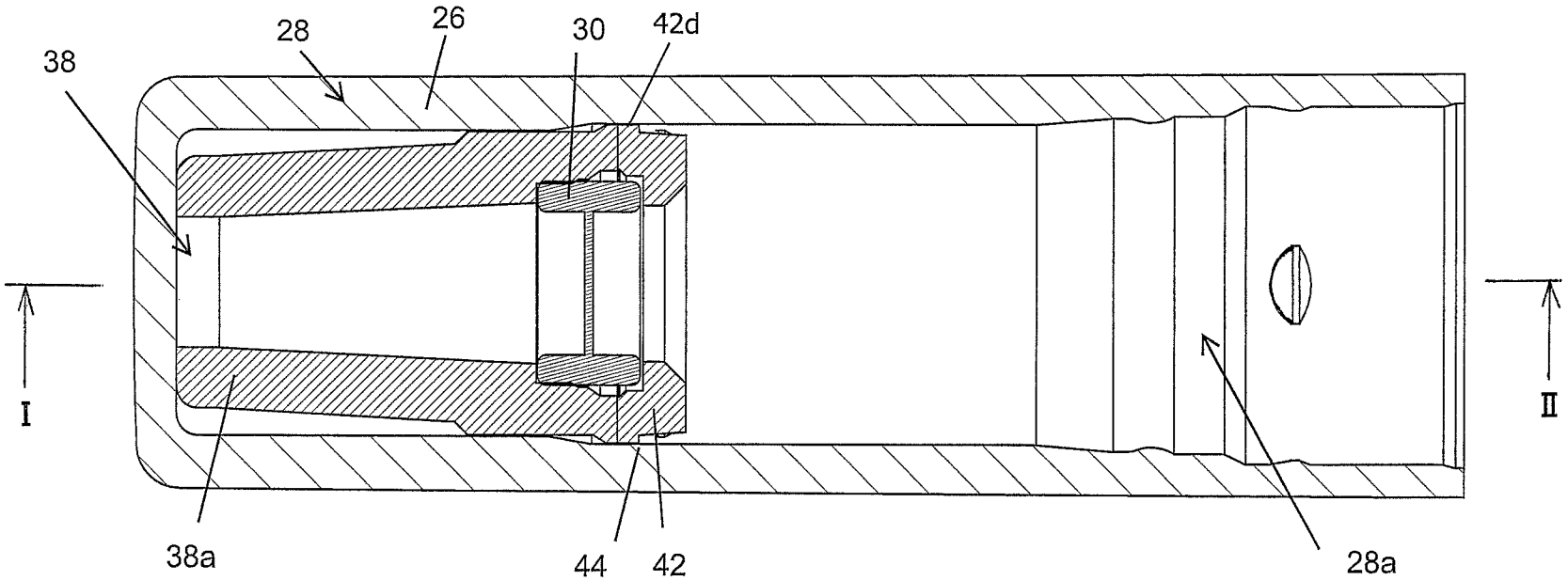
FIG. 2*a* is an enlarged view of the cap in FIG. 1*b;*
Figure 2B:
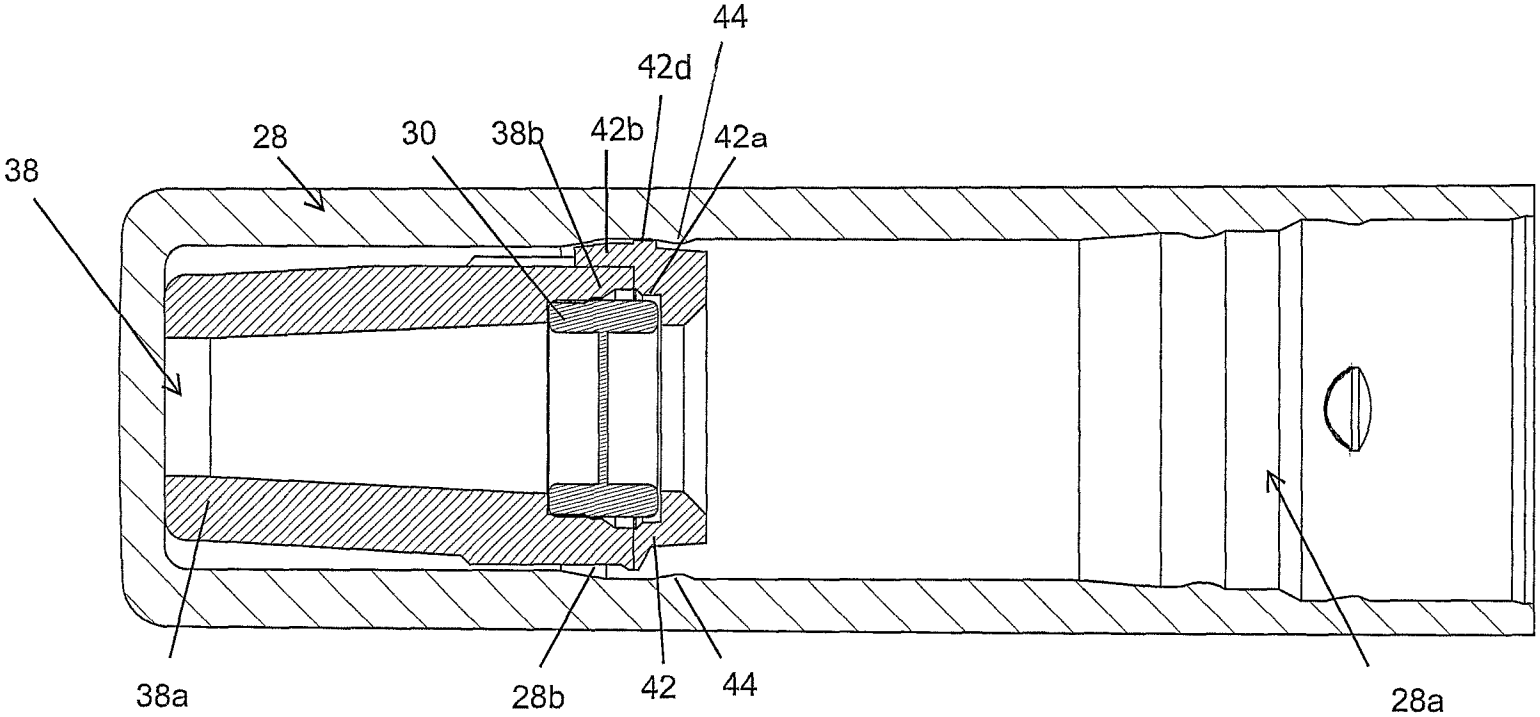
FIG. 2*b* is a vertical sectional view cut along a line I-II in FIG. 2*a*, as viewed from a position rotated 90 degrees from the position in FIG. 2*a;*

Here, attached to a front end part 10*a* of the barrel body 10 are a joint 22, an applying part 24 and a front barrel 26, as shown in FIG. 1*b*. The contents (a fluid such as a fluent makeup in the present embodiment) fed from the reservoir 20 of the barrel body 10 is delivered from the tip on the front side of an applying part 24.

The applicator of the first embodiment has a removable cap 28 that totally covers the applying part in the front part of the applicator. When this cap 28 is fitted, the front end on the front side of the applying part 24 is sealed up by a sealing element 30 (FIG. 1*b*).

When the applicator is used, the cap 28 is removed so as to expose the applying part 24, allowing writing. When the applicator is unused after writing, the cap 28 is fitted to the front end of the barrel body 10 so that spillage of the contents from the applying part 24 is prevented by the sealing element 30.

The barrel body 10 has the front end part 10*a* on the front side in the axial direction, the front end part 10*a* having a stepped form formed becoming smaller in diameter toward the front side. The cylindrical joint 22 is fitted into the front end part 10*a*. The joint 22 and the front end part 10*a* are covered by the front barrel 26. The pipe-like applying part 24 is supported by the front interior of the front barrel 26 and the front part of the joint 22 (FIG. 1*b*).

In this arrangement, the cap 28 can be fitted so as to cover the applying part 24 and front barrel 26 (FIG. 1*b*).

The clicking mechanism A may have any configuration as long as it can advance the piston 18 to the front side when the click cover 12 is pushed. As an example, the click mechanism A disclosed in Japanese Patent Application Laid-open 2010-88793 may be used.

In the click mechanism A, a rotational body 32 is assembled inside the threaded body 14 whose rear part cylindrically extends while the screw rod 16 is inserted through the axial center.

The click cover 12 is arranged rotatably at the rear end of rotational body 32 and restricted from moving in the axil direction. The rotational body 32 has an annular configuration in which a first cam surface facing forward is formed at the front end and a second cam surface facing rearward is formed on the outer periphery in the middle part, and is arranged so as to be rotatable and axially movable inside the barrel body 10 and the threaded body 14.

The threaded body 14 has a stepped small-diametric tubular part in the front end, formed with a female thread in the bore therein and a first fixed cam surface in the rear face of the tubular part.

A cam body 34 is assembled inside the tubular rear part of the threaded body 14 to cover the rotational body 32, and has a second fixed cam surface formed on the front end thereof.

The threaded body 14 and the cam body 34 are fixed in the rotational direction and the axial direction relative to the barrel body 10. A spring 36 urging the rotational body 32 rearward (to the rear side) is arranged in the threaded body 14.

When the user clicks the click cover 12, the first cam surface of the rotational body 32 meshing the first fixed cam surface of the threaded body 14 is guided along the tooth of the first fixed cam surface by the pressing force opposing the spring 36, whereby the rotational body 32 moves forward (toward the front side) rotating in the predetermined rotational direction by one tooth.

On the other hand, when the pressing force is cancelled, the rotational body 32 moves rearward by the repulsive force of the spring 36, and the second cam surface meshes the second fixed cam surface of the cam body 34 so that the second cam surface is guided along the tooth, whereby the rotational body 32 moves rearward (toward the rear side) rotating in the predetermined rotational direction by one tooth.

The clicking mechanism A is configured so as to produce rotary motion by the cams as above. Rotation of the rotational body 32 makes the screw rod 16 turn to advance the piston 18 toward the front side by means of threaded body 14 and thereby deliver the contents.

FIG. 2 shows the cap 28, FIG. 3 shows an inner cap 38 in its closed state, FIG. 4 shows the inner cap 38 in its open state, and FIG. 5 shows the cap 28.

As shown in FIG. 2, the cap 28 totally covers the applying part 24 (FIG. 1*b*) in the front part of the applicator and seals up the front end part of the applying part 24 with the sealing element 30 when the cap 28 is attached to the applicator (FIG. 1*b*).

The inner cap 38 is inserted into and fixed inside the cap 28 (FIG. 2).

As shown in FIGS. 3 and 4, the inner cap 38 is configured so that a hollow hinged cap 42 is joined to an inner cap body 38*a* via a strip-like bendable hinge structure 40.

As shown in FIG. 5, a plurality of projected engagement parts 44 (FIGS. 2*b*, 5*a* and 5*b*) for fixing the hinged cap 42 are formed inside the cap 28.

The inner cap body 38*a* has a large-diametric rear part. The hinge structure 40 is contiguously formed in part of the outer periphery of the rear part. The inner cap body 38*a* is joined to the hinged cap 42 via the hinge structure 40 (FIG. 3*c*).

In the inner cap 38, the sealing element 30 is set inside the inner cap body 38*a*, then the hinge structure 40 is bent so that the hinged cap 42 abuts the rear opening side of the inner cap body 38*a*, whereby the sealing element 30 can be held in a predetermined condition inside the inner cap 38.

The cylindrical outer peripheral surface of the hinged cap 42 is formed to be tapered, becoming gradually narrower from the front side to the rear side.

Further, a flange-like projection 42*d* is formed along the front side opening on the outer peripheral surface of the hinged cap 42 except the position where the hinge structure 40 is joined.

Here, the configuration of the projection 42*d* is not limited to the flange form, but may have any form as long as it can be engaged with the engaging parts 44 described below.

Further, instead of providing projection 42*d*, the outer peripheral surface of hinged cap 42 may be tapered so as to be able to engage with the engaging parts 44.

That is, the hinged cap 42 may have any configuration as long as its outer peripheral surface can be engaged by the engaging parts 44.

Formed inside the hinged cap 42 is a hollow part that is defined by an aftermentioned stepped portion 42*a* that serves as a mounting portion for mounting the sealing element 30.

Formed on the rear side of the hinged cap 42 is an opening 42*c* that communicates with the hollow part defined by the stepped portion 42*a*.

As the inner cap 38 is inserted into the cap 28 with the sealing element 30 held between the hinged cap 42 and the inner cap body 38*a*, the inner cap 38 goes toward the front side, passing over the engaging parts 44 (FIG. 5) inside the cap 28 until the rear side of projection 42*d* of the hinged cap 42 engages with the front side of engaging parts 44. As a result, the inner cap 38 can be engaged and fixed inside the cap 28 (FIG. 2*b*). That is, the rear side of projection 42*d* engages with the front side of engaging parts 44 so as to prevent the inner cap 38 from falling off from the inside of cap 28.

The sealing element 30 is arranged so as to be seen through the circular opening 42*c* of the hinged cap 42 when the inner cap 38 has been inserted in the cap 28. Here, the opening 42*c* may have any configuration as long as the front end of the applying part 24 can pass through the hinged cap 24, hence the size and shape of the opening 42*c* are not limited.

Minutely, the cap 28 is a hollow cylinder closed on the front side and opened to the rear, as shown in FIGS. 2 and 5.

As shown in FIG. 5, the interior of the cap 28 is so formed that the front part is slightly reduced in inside diameter and enlarged at a stepped portion 28*b*. Formed on the inner side a distance rearward from the stepped portion 28*b* are a plurality of isolated projections as engaging parts 44 located at the same position with respect to the axial direction.

In assembling, the front end of inner cap 38 abuts the front end inside the cap 28 while the rear side of the projection 42*d* on the outer peripheral surface of hinged cap 42 in the rear of inner cap 38 interferes with the front side of the engaging parts 44, whereby the inner cap 38 is fixed in the front end inside the cap 28 so that the hinged cap 42 will not open.

Further, an projected and indented portion 28*a* formed of a plurality of continuous or discrete annular ribs is formed on the inner periphery in the rear of engaging parts 44 and in the rear part of the cap 28 (FIGS. 2 and 5). When the cap 28 is attached to the barrel body 10, the projected and indented portion 28*a* fits on the outer peripheral surface of the rear side of the front barrel 26 of the front end of barrel body 10, so that the cap will not come off until a predetermined force is applied.

Before the hinged cap 42 is closed, the inner cap 38 assumes such a form that the cylindrical inner cap body 38*a* that is opened at both ends is joined to the annular hinged cap 42 by the strip-like hinge structure 40, as shown in FIG. 4. The opposing surfaces of the inner cap body 38*a* and the hinged cap 42 are formed of surfaces having almost the same external forms.

As shown in FIGS. 3 and 4, the inner cap body 38*a* has an outer peripheral configuration tapered toward the front side, corresponding to the inner peripheral side of the cap 28. The inner peripheral wall in the rear part of the inner cap body 38*a* is stepped to enlarge its diameter forming a mounting portion 38*b* (FIGS. 2*b*, 3*e*, 4*c* to 4*f*) for receiving the sealing element 30 and formed with a plurality of projections. The interior of the hinged cap 42 on the front side is also formed with a stepped portion (mounting portion) 42*a* (FIGS. 3*e*, 4*c* to 4*e*) forming a reduced diameter such as undercut.

Figure 3E:
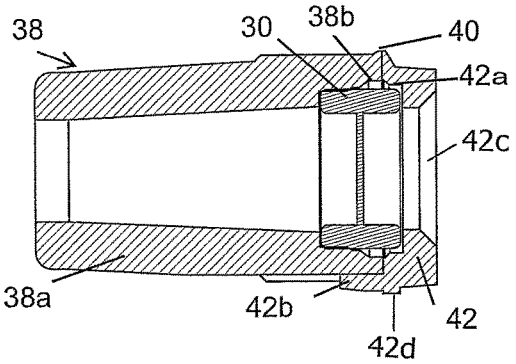
FIG. 3*e* is a sectional view cut along a line I-II in FIG. 3*c;*

The inner cap 38 has an arrangement that can hold and fix the sealing element 30 without play between the mounting portion 38*b* of the inner cap body 38*a* and the stepped portion 42*a* (FIGS. 2 and 3*e*).

The hinged cap 42 has a hooking part 42*b* that is projected to the front side in the axial direction, formed on the opposite side of the hinge structure 40 (FIGS. 2*b*, 3*d* to 3*f* and 3*h*).

Figure 3F:
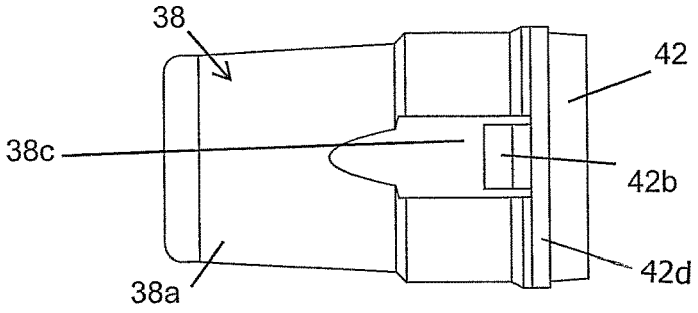
FIG. 3*f* is a side view of the inner cap according to the first embodiment, viewed from the engagement structure side.
Figure 3G:
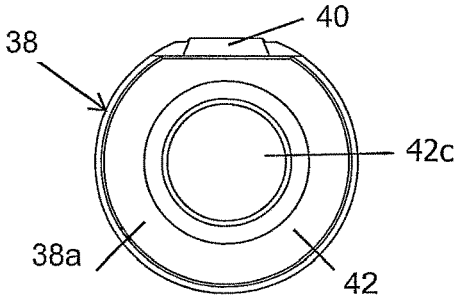
FIG. 3*g* is a view of the inner cap according to the first embodiment, viewed from the rear side.
Figure 3H:
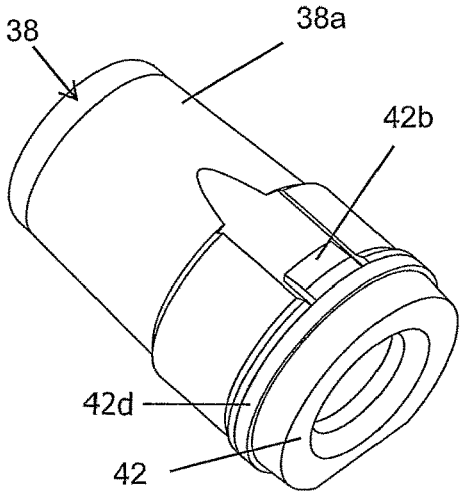
FIG. 3*h* is a perspective view of the inner cap according to the first embodiment, viewed from the rear side.

That is, when the hinged cap 42 is closed, the hooking part 42*b* abuts the inner cap body 38*a* along the outer periphery thereof so as to position the hinged cap 42 with respect to the radial direction. The part (38*c*) of inner cap body 38*a* abutting the hooking part 42*b* is formed with a flat surface (FIGS. 3*f* and 4*f*).

The inner cap body 38*a*, hinge structure 40 and hinged cap 42 of the embodiment may be formed of resins (or partly with metals) that are selected as appropriate. For example, these components may be formed integrally of an identical material, may be separately formed of different materials and joined by a hinge structure, may be formed by two-color molding of different materials, or may be formed by any other method as appropriate.

The sealing element 30 has an H-section configuration formed by integrating a cylinder and a membrane therein (FIGS. 2 and 3*e*). This is a mere example. The sealing element may be a thick plate, spherical, or of any other shape. The sealing element 30 is preferably formed of resilient elastomers such as NBR (nitrile rubber), EPDM (ethylene-propylene diene rubber), thermoplastic elastomer, silicone resin and the like, by selecting as appropriate depending on the material of the application liquid and other factors.

The applying part 24 (FIG. 1*b*) of the embodiment has a pipe-like configuration. When the cap 28 is attached, the tip of the applying part 24 passes through the opening 42*c* of the hinged cap 42 and pushes the membrane of the sealing element 30 so that the membrane is extended and deformed to the front side while sealing the opening at the tip of applying part 24. Accordingly, as the cap 28 is attached to the front barrel 26, the sealing element 30 comes into close contact with the opening at the tip of applying part 24, to thereby definitely prevent the application liquid from flowing out.

The sectional area of the opening of the applying part 24 is preferably 0.2 $mm^2$ or greater.

The position of the sealing element 30 inside the inner cap 38 with respect to the axial direction can be arbitrarily selected within a range in which the above operation and effect can be achieved when the cap 28 is set in place.

The application liquid to be applied by the applicator preferably contains solids content of 5% by weight or higher as a coating component.

According to the applicator according to the first embodiment, when the inner cap 38 is mounted into the cap 28 with the sealing element 30 held between the hinged cap 42 and the inner cap body 38*a* by bending the hinged cap at the hinge structure 40, the hinged cap 42 can be engaged and fixed with engaging parts 44 inside the cap 28. Since the sealing element 30 is arranged so as to be seen from the rear side of the hinged cap 42 via the opening 42*c* of hinged cap 42, it is possible to achieve excellent operation and effect of firmly fixing the sealing element 30 with a simple configuration.

Next, an applicator provided with a cap according to the second embodiment will be described with reference to FIGS. 6*a* to 8*g*. In this case, the same components as those of the applicator of the first embodiment will be allotted with the same reference numerals.

Figure 6A:
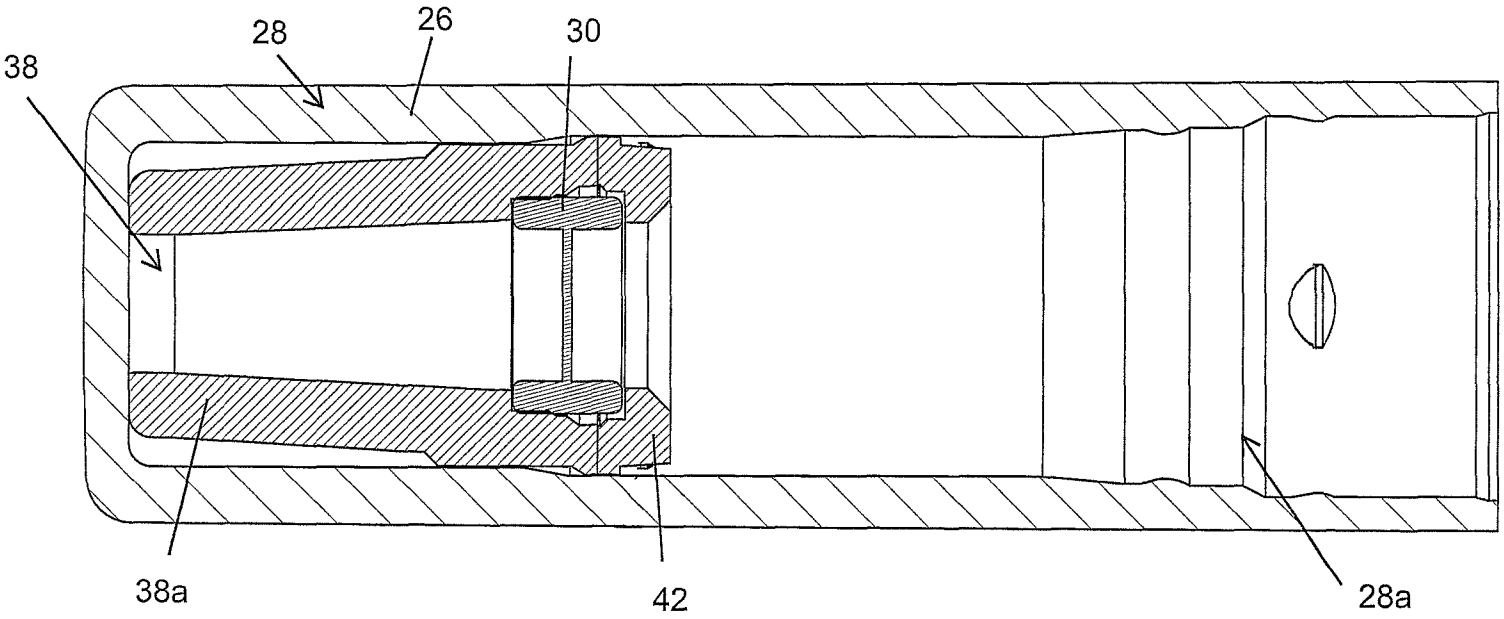
FIG. 6*a* is a sectional view corresponding to the sectional view of FIG. 2*a*, of a cap of an applicator according to a second embodiment of the present invention.
Figure 6B:
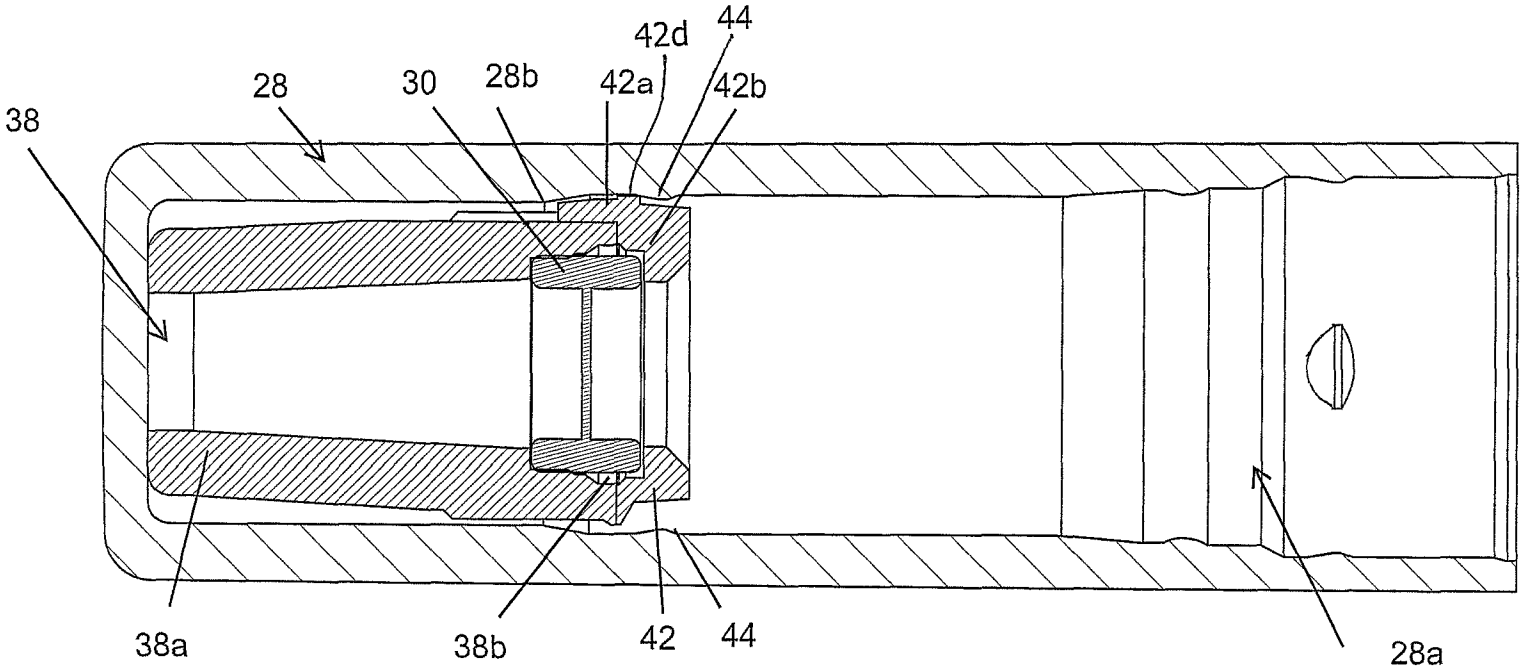
FIG. 6*b* is a vertical sectional view cut along a line I-II in FIG. 6*a*, as viewed from a position rotated 90 degrees from the position in FIG. 6*a;*

Here, in the following description, FIGS. 6*a* and 6*b* may also be collectively referred to as FIG. 6. FIGS. 7*a* to 7*i* may also be collectively referred to as FIG. 7. FIGS. 8*a* to 8*g* may also be collectively referred to as FIG. 8.

As shown in FIGS. 6 to 8, in the applicator according to the second embodiment, an engagement structure 46 (FIGS. 7*f* and 7*g*) is provided between the hinged cap 42 and the inner cap body 38*a*. With the sealing element 30 held therebetween, hinged cap 42 is folded at the hinge structure 40 so that the hinged cap 42 and the inner cap body 38*a* can be engaged with each other by the engagement structure 46.

Specifically, the engagement structure 46 is comprised of projections 46*a* on the hinged cap 42 side and ribs 46*b* on the inner cap body 38*a* side.

Figure 7C:
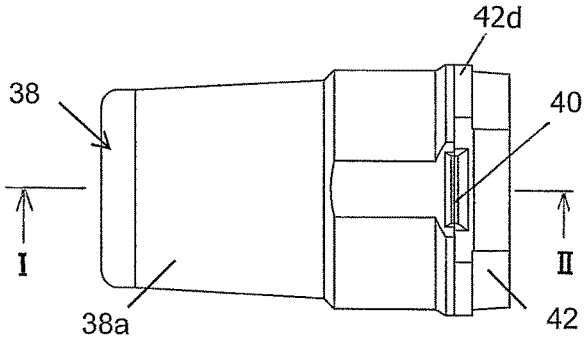
FIG. 7*c* is a side view of the inner cap according to the second embodiment, viewed from the hinge structure side.
Figure 7A:
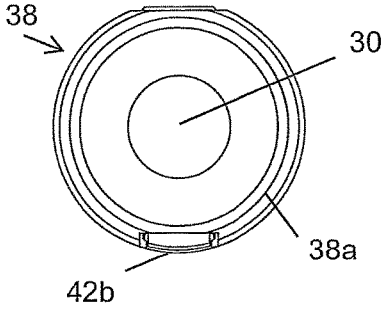
FIG. 7*a* is a view of an inner cap according to the second embodiment of the present invention, viewed from its front side.
Figure 7D:
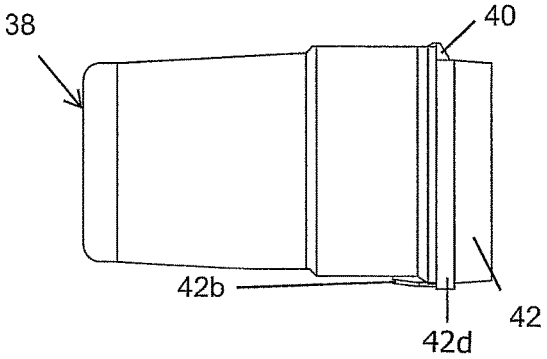
FIG. 7*d* is a side view of the inner cap with the hinge structure down according to the second embodiment.
Figure 7B:
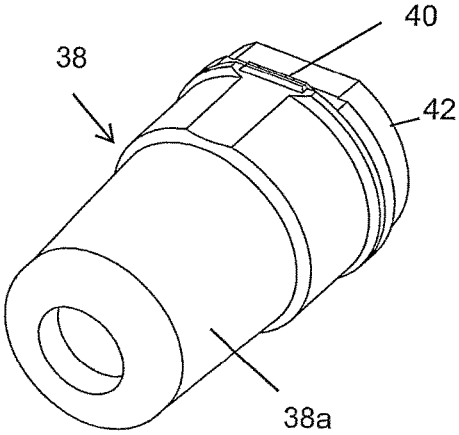
FIG. 7*b* is a perspective view of the inner cap according to the second embodiment, viewed from its front side.
Figure 7E:
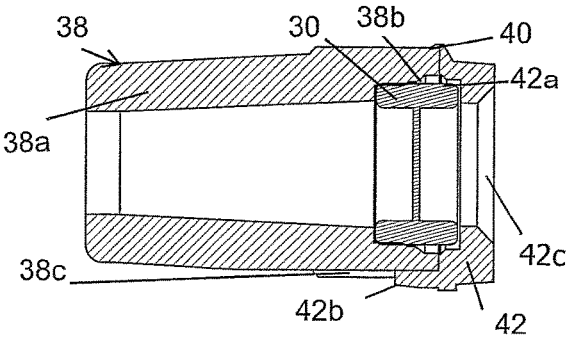
FIG. 7*e* is a sectional view cut along a line I-II in FIG. 7*c;*
Figure 7F:
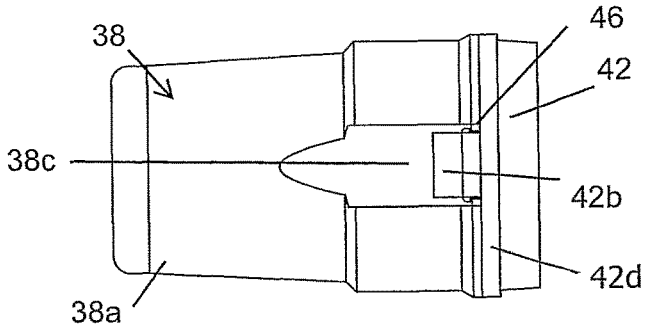
FIG. 7*f* is a side view of the inner cap according to the second embodiment, viewed from the engagement structure side.
Figure 7G:
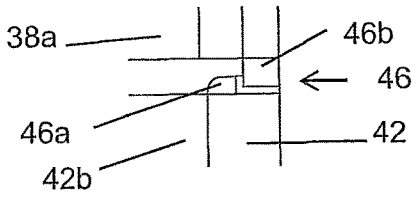
FIG. 7*g* is an enlarged view of an engagement structure of the inner cap according to the second embodiment.
Figure 7H:
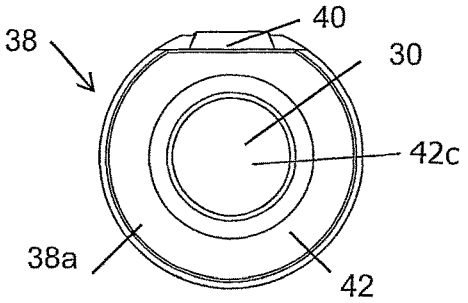
FIG. 7*h* is a view of the inner cap according to the second embodiment, viewed from its rear side.
Figure 7I:
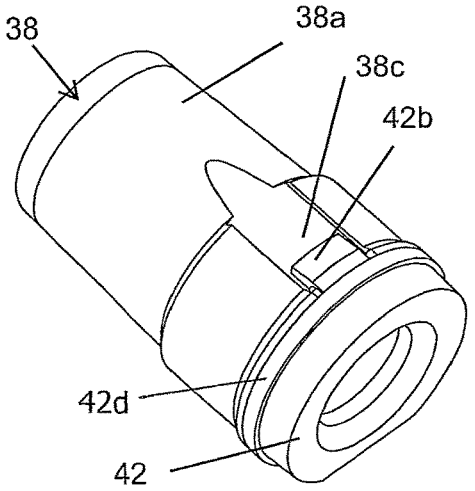
FIG. 7*i* is a perspective view of the inner cap according to the second embodiment, viewed from its rear side.
Figure 8A:
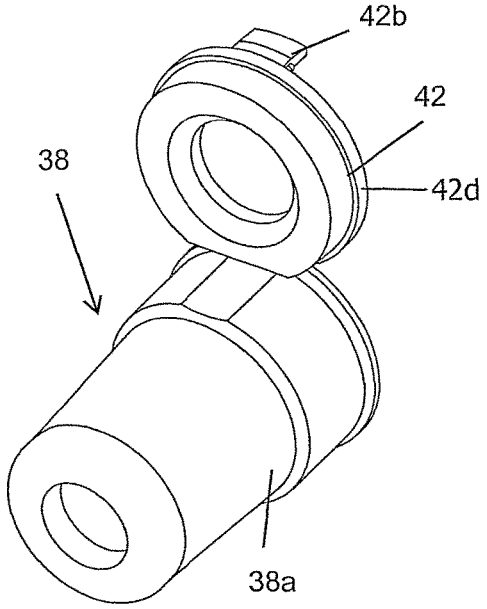
FIG. 8*a* is a perspective front view of the inner cap with a hinged cap open according to the second embodiment.
Figure 8C:
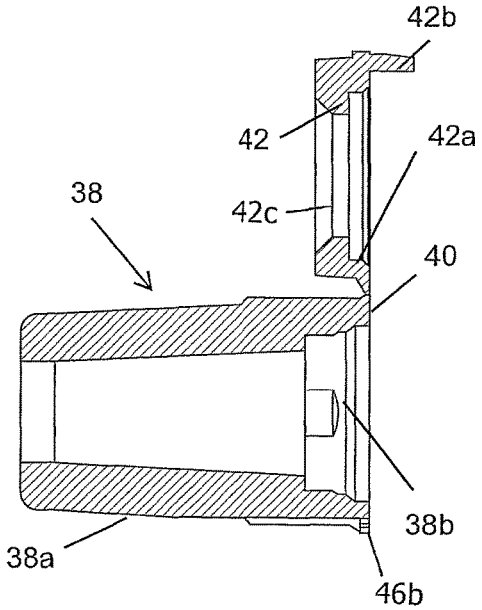
FIG. 8*c* is a vertical sectional view cut along a line I-II in FIG. 8*d;*
Figure 8B:
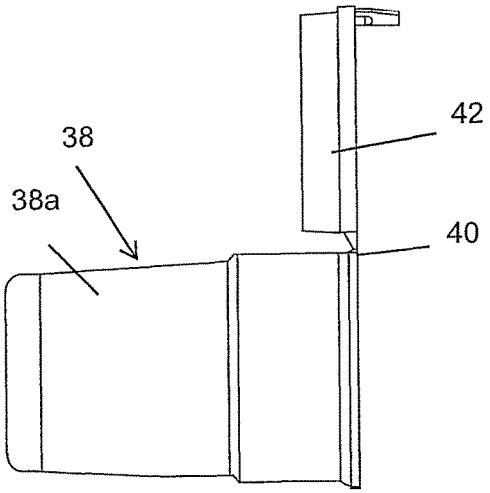
FIG. 8*b* is a side view showing the inner cap with the hinged cap open according to the second embodiment.
Figure 8D:
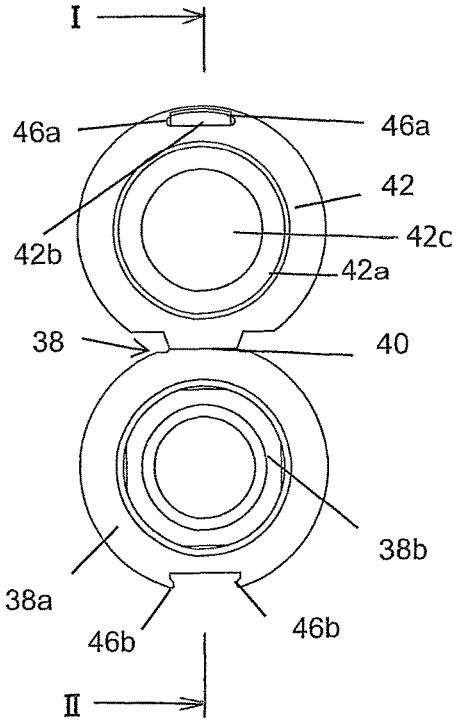
FIG. 8*d* is a view of the inner cap with the hinged cap open as viewed from its rear side according to the second embodiment.
Figure 8E:
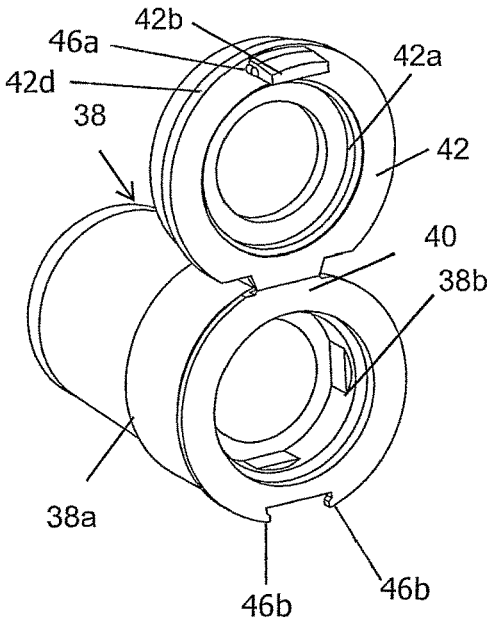
FIG. 8*e* is a perspective view of the inner cap with the hinged cap opened and positioned up according to the second embodiment, viewed from its rear side.
Figure 8F:
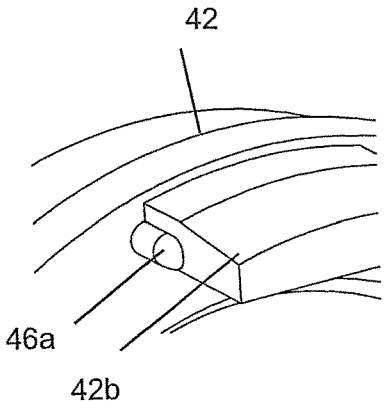
FIG. 8*f* is a perspective enlarged view of a projection and its surrounding of the inner cap according to the second embodiment.
Figure 8G:
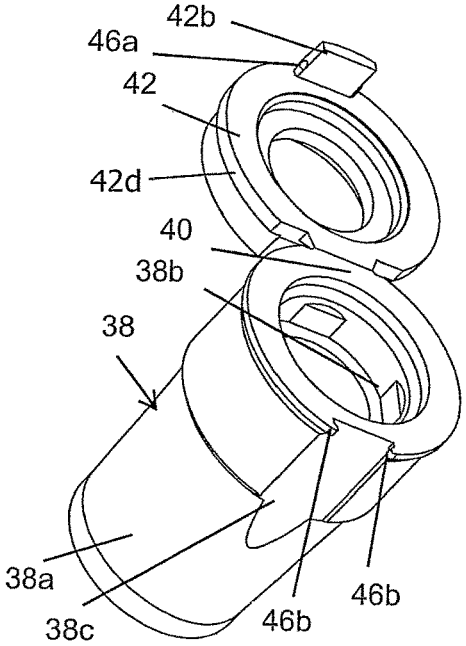
FIG. 8*g* is a perspective rear view of the inner cap with the hinged cap open as viewed from the main body side according to the second embodiment.
Figure 9A:
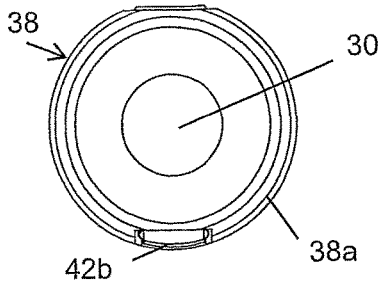
FIG. 9*a* is a view showing an inner cap with a sealing element held therein according to a variational example 1 of the present invention.
Figure 9B:
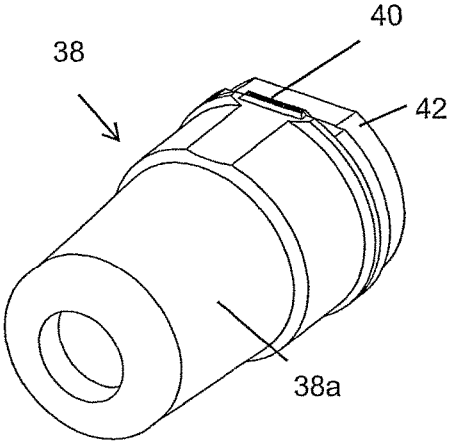
FIG. 9*b* is a perspective view of the inner cap from its front side according to the variational example 1.
Figure 9C:
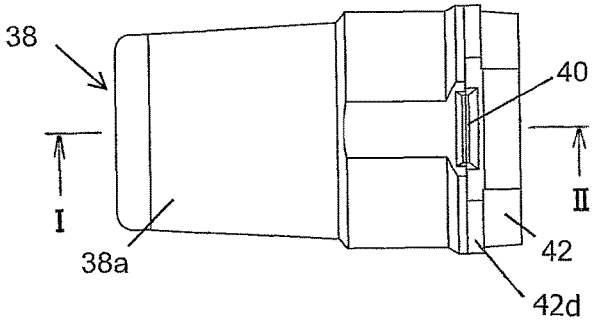
FIG. 9*c* is a side view of the inner cap according to the variational example 1, viewed from the hinge structure side.
Figure 9D:
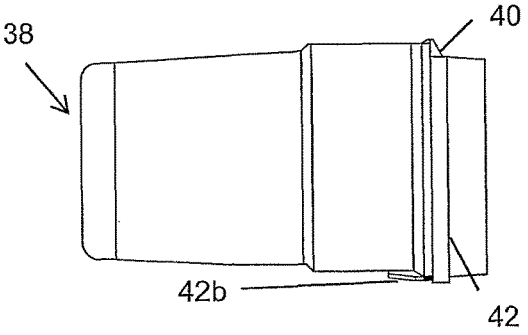
FIG. 9*d* is a side view of the inner cap with the hinge structure down according to the variational example 1.
Figure 9E:
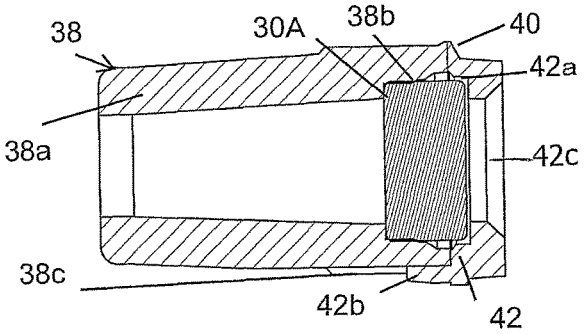
FIG. 9*e* is a sectional view cut along a line I-II in FIG. 9*c;*
Figure 9F:
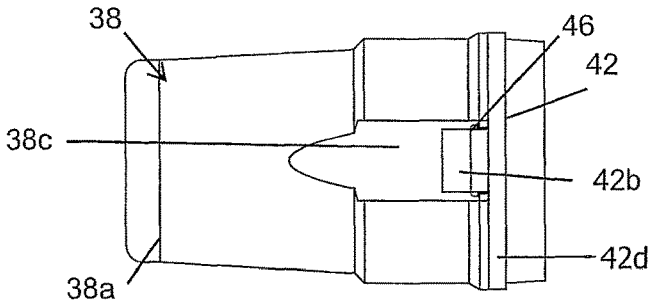
FIG. 9*f* is a side view of the inner cap according to the variational example 1, viewed from the engagement structure side.
Figure 9G:
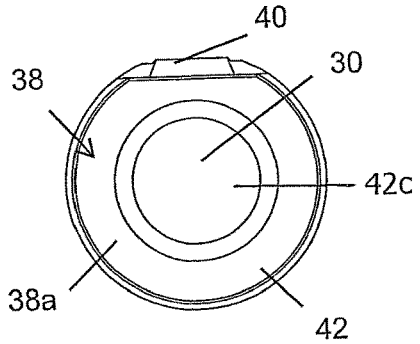
FIG. 9*g* is a view of the inner cap according to the variational example 1, viewed from the rear side.
Figure 9H:
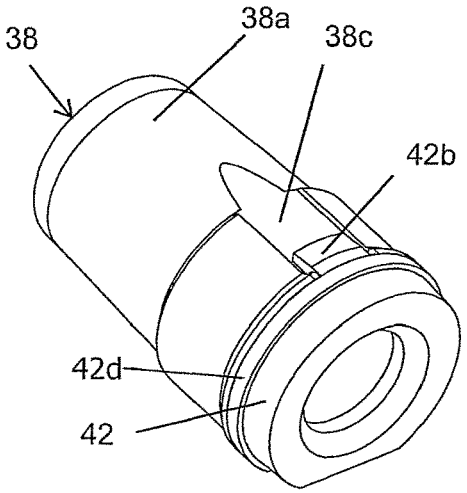
FIG. 9*h* is a perspective view of the inner cap according to the variational example 1, viewed from the rear side.
Figure 10A:
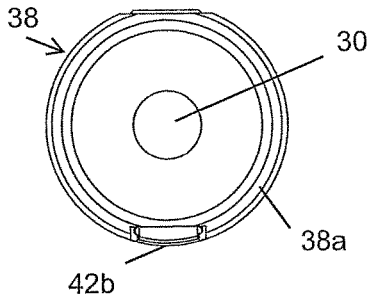
FIG. 10*a* is a view showing an inner cap with a sealing element held therein according to a variational example 2 of the present invention, viewed from the front side.
Figure 10C:
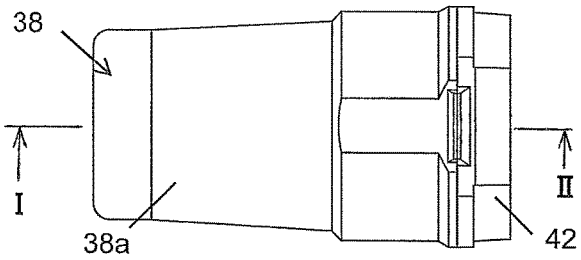
FIG. 10*c* is a side view of the inner cap according to the variational example 2, viewed from the hinge structure side.
Figure 10D:
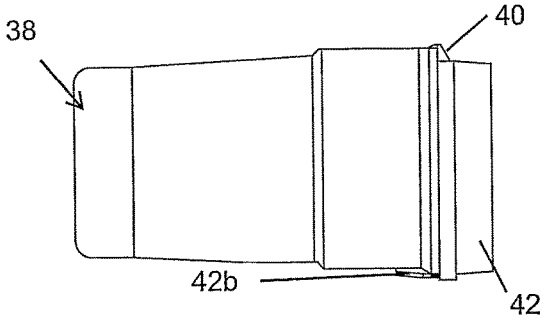
FIG. 10*d* is a side view of the inner cap with the hinge structure down according to the variational example 2.
Figure 10B:
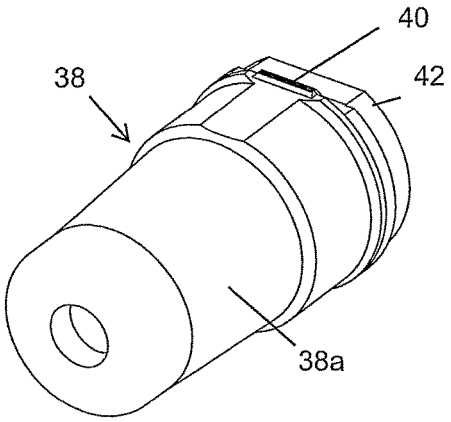
FIG. 10*b* is a perspective view of the inner cap according to the variational example 2, viewed from its front side.
Figure 10E:
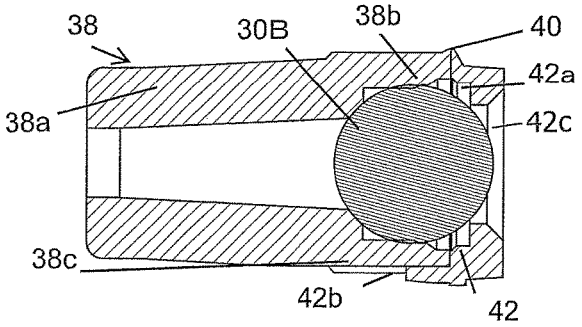
FIG. 10*e* is a sectional view cut along a line I-II in FIG. 10*c;*
Figure 10F:
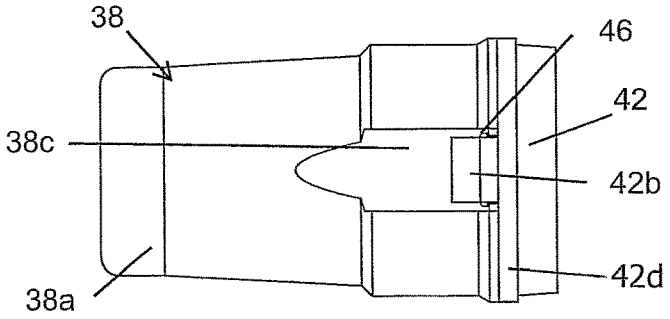
FIG. 10*f* is a side view of the inner cap according to the variational example 2, viewed from the engagement structure side.
Figure 10G:
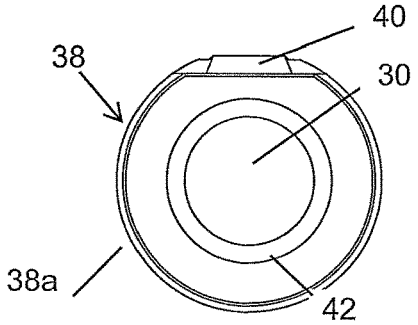
FIG. 10*g* is a view of the inner cap according to the variational example 2, viewed from the rear side; and, FIG. 10*h* is a perspective view of the inner cap according to the variational example 2, viewed from the rear side.
Figure 10H:
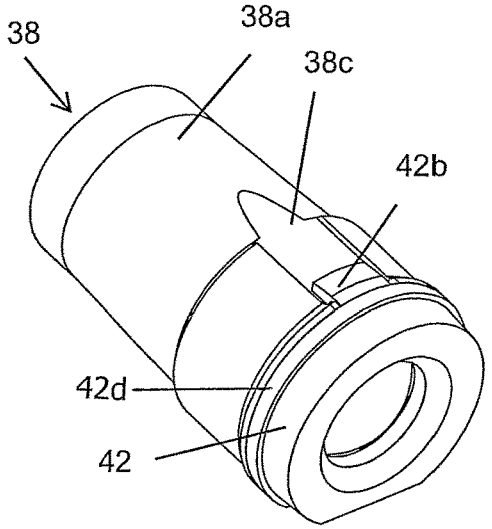

As to the projections 46*a* on the hinged cap 42 side, the hooking part 42*b* of the hinged cap 42 has a rounded semicylindrical projection 46*a* projected in the width direction on both sides with respect to the width direction, as enlarged shown in FIGS. 7*g* and 8*g* (FIGS. 8*d* to 8*g*).

As to the ribs 46*b* on the inner cap body 38*a* side, with the inner cap body 38*a* closed by the hinged cap 42, ribs 46*b* that extend in the circumferential direction opposing projections 46*a* so as to engage the outer peripheral side of projections 46*a* are formed projectively at the opposing positions of the inner cap body 38*a* (FIGS. 7*g*, 8*d*, 8*e* and 8*g*).

According to the second embodiment, when the hinged cap 42 abuts the inner cap body 38*a*, projections 46*a* are engaged with ribs 46*b* so that the hinged cap 42 is fixed at the position opposite to the inner cap body 38*a* to thereby prevent the hinged cap 42 from opening.

As a result, since the hinged cap 42 will not open with the sealing element 30 held in the inner cap 38, the sealing element 30 is unlikely to dislodge when the inner cap 38 is fitted into the cap 28, hence facilitating assembly. Further, the engagement structure 46 increases the resistance against release of the hinged cap 42 after assembly, so that attachment of the sealing element 30 can be further enhanced.

The present invention should not be limited to the above first and second embodiments, but various changes can be made within the scope of the invention.

For example, as to the sealing element, other than that described in the first and second embodiments, a variational example 1 shown in FIGS. 9*a* to 9*h* and a variational example 2 shown in FIGS. 10*a* to 10*h* can be adopted.

Here, in the following description, FIGS. 9*a* to 9*h* may also be collectively referred to as FIG. 9. FIGS. 10*a* to 10*h* may also be collectively referred to as FIG. 10.

FIG. 9 is an illustrative diagram showing an inner cap 38 with a sealing element 30A held therein according to a variational example 1, where the sealing element 30A is held between the inner cap 38 and hinged cap 42. FIG. 10 is an illustrative diagram showing an inner cap 38 with a sealing element 30B held therein according to another variational example 2, where the sealing element 30B is held between the inner cap 38 and hinged cap 42. The same components as those of the inner cap in the second embodiment are allotted with the same reference numerals.

As shown in FIG. 9, the sealing component 30A according to the variational example 1 has a solid and approximately cylindrical or solid and button-like configuration so as to wrap up the applying part 24 that enters far inwards even when the tip of the applying part is strongly pushed in, hence making it possible to prevent leakage of the application liquid from the applying part 24. The sealing element 30A according to the variational example 1 is thick enough to receive the applying part 24 compared to the sealing elements 30 in the first and second embodiments, so that its endurance is high. Further, the sealing element has a simple shape, hence can be easily formed.

As shown in FIG. 10, the sealing component 30B according to the variational example 2 has a solid and approximately spherical configuration so as to wrap up the applying part 24 that enters far inwards even when the tip of the applying part is strongly pushed in, hence making it possible to prevent leakage of the application liquid from the applying part 24. The sealing element 30B according to the variational example 2 is thick enough to receive the applying part 24 compared to the sealing elements 30 in the first and second embodiments, so that its endurance is high. Further, the sealing element 30B is spherical, hence can be easily formed. Moreover, the sealing element 30B is spherical, so that the sealing element can be positioned by just dropping it without the need of special positioning to the mounting portion 38*b* when the element is set to the inner cap 38. Accordingly, this sealing element can be assembled more easily compared to that in the first, second embodiments and variational example 1.

INDUSTRIAL APPLICABILITY

The applicators of the present invention can be applied to writing implements and various applicators for correction fluid, cosmetics, etc.

DESCRIPTION OF REFERENCE NUMERALS

A clicking mechanism
10 barrel body
18 piston
20 reservoir
24 applying part
28 cap
28*a* rear projected and indented portion
28*b* stepped portion
30 sealing element
38 inner cap
38*a* inner cap body
38*b* mounting portion
40 hinge structure
42 hinged cap
42*a* stepped portion (mounting portion)
42*b* hooking part
42*c* opening
42*d* projection
44 engaging part
46 engagement structure
46*a* projection
46*b* rib

What is claimed is:

1. An applicator comprising:

an applying part on a front side of the applicator;

a removable cap that totally covers the applying part;

an inner cap secured inside the removable cap, the inner cap comprising:

an inner cap body, a hinged portion joined to the inner cap body and configured to abut the inner cap body, and a sealing element secured between said inner cap body and said hinged portion;

the hinged portion having a mounting portion and comprising an opening, said removable cap comprising an engaging portion on the inside thereof for securing the inner cap therein by engagement with the mounting portion of the hinged portion of the inner cap, wherein the inner cap having the sealing element held between the inner cap body and the hinged portion thereof is fitted into the interior of the removable cap, the hinged portion being engaged by the engaging portion inside the removable cap with said sealing element exposed through the opening of the hinged portion, whereby when the removable cap is fitted to the applicator, the front end portion of the applying part comes into contact with the sealing element and is thereby sealed.

2. The applicator according to claim 1, wherein the inner cap body and the hinged cap are joined by a bendable hinge structure.

3. The applicator according to claim 2, wherein an engagement structure is provided between the hinged cap and the inner cap body, and when the hinged cap is folded at the hinge structure in a state that the sealing element is held in the inner cap body, the hinged cap and the inner cap body are engaged with each other by the engagement structure.

4. The applicator according to claim 1, wherein a sectional area of an opening of the applying part is 0.2 $mm^2$ or greater.

5. The applicator according to claim 1, wherein an application liquid to be applied by the applicator contains solids content of 5% by weight or greater as a coating component.

* * * * *